United States Patent [19]

Bliss et al.

[11] Patent Number: 5,021,159

[45] Date of Patent: Jun. 4, 1991

[54] APPARATUS FOR THICKENING PULP AND PAPER STOCK

[75] Inventors: Terry L. Bliss; David E. Chupka; Christopher E. McCarthy; Larry J. Walters, all of Middletown, Ohio

[73] Assignee: The Black Clawson Company, Middletown, Ohio

[21] Appl. No.: 229,673

[22] Filed: Aug. 8, 1988

[51] Int. Cl.[5] ..... B01D 33/00

[52] U.S. Cl. ..... 210/396; 210/401; 210/402; 210/407; 162/55

[58] Field of Search ..... 210/396, 402, 401, 407; 162/286, 281

[56] References Cited

U.S. PATENT DOCUMENTS

| | | | |
|---|---|---|---|
| 1,241,905 | 10/1917 | Behr . | |
| 2,271,385 | 1/1940 | Best | 210/201 |
| 2,913,365 | 11/1959 | Osborne et al. | 162/201 |
| 2,936,073 | 5/1960 | Thompson | 210/67 |
| 2,997,176 | 8/1961 | Delmas | 210/67 |
| 4,146,484 | 3/1979 | Campbell | 210/396 |
| 4,185,399 | 1/1980 | Gladish | 34/120 |
| 4,501,662 | 2/1985 | Biondetti | 210/396 X |
| 4,722,793 | 2/1988 | Seifert et al. | 210/401 |

*Primary Examiner*—David A. Simmons
*Assistant Examiner*—Thi Dang
*Attorney, Agent, or Firm*—Biebel, French & Nauman

[57] ABSTRACT

In apparatus for thickening a suspension of pulp material which includes an endless foraminous belt wrapping two spaced horizontally supported rolls, a special doctor mechanism is provided for transferring thickened pulp from the bare surface of the second roll into a trough mounted in the space bounded by the two rolls and the upper and lower runs of the belt. More specifically, the doctor mechanism includes a rigid doctor blade mounted with its working edge in close but spaced relation with the bare surface of the roll to remove pulp therefrom without contact with the roll surface. Provision is also made for periodically oscillating the blade about a horizontal axis to move its working edge away from and back to its closely spaced working relation with the roll.

3 Claims, 2 Drawing Sheets

APPARATUS FOR THICKENING PULP AND PAPER STOCK

BACKGROUND OF THE INVENTION

The present invention has particular relation to the apparatus for thickening pulp and paper stock shown in Seifert et al U.S. Pat. No. 4,722,793, issued Feb. 2, 1988 to the assignee of this application. The apparatus disclosed in that patent comprises, as its major component, a pair of liquid-impervious rolls rotatably mounted in spaced relation on substantially horizontal axes. An endless wire is trained around these rolls in wrapping relation with a substantial portion of the surfaces of each thereof, and means are provided for driving one of the rolls to cause this wire to travel around the rolls while cooperating therewith to define a space mounted by the rolls and the opposed upper and lower runs of the wire.

A headbox is mounted in this space and includes an outlet for the pulp suspension to be thickened which is delivered into the space between one of the rolls and the portion of the wire wrapping that roll, whereby this pulp suspension is trapped between the wire and the roll. The rolls are driven at a speed effecting the development of centrifugal force causing liquid to be expressed from between the wire and rolls with the resulting thickening of the pulp carried on the inner surface of the wire, and means are provided to collect and remove this thickened pulp from the space bounded by the wire and rolls.

As is pointed out in the above patent, the apparatus disclosed therein is capable of operating at very much higher speeds than conventional thickening apparatus of the decker type, namely speeds in the range of 1500–4000 feet per minute as compared with decker operation at a linear speed in the range of 200–300 feet per minute. As a result, the capacity of such apparatus, in terms of tons per day of pulp, is correspondingly high, and in developing that apparatus for the marketplace, it was found that special provision should be made for facilitating the collection and removal of the thickened pulp.

Doctor blades of conventional types and mountings, such as are shown in the above patent, were found to have certain disadvantages for this purpose. More specifically, the use of a doctor blade in contact with the surface of the roll was found to be undesirable, for a number of reasons. For one, the resulting friction between the edge of the blade and the roll caused accelerated abrasion damage to both the blade and the surface of the roll, and this abrasion damage was magnified when the apparatus was used, as is conventional, for the thickening of waste paper pulp stock which had been only roughly screened and therefore contained many metal and other hard contaminant particles such as paperclips and staples.

Another problem appeared when a conventionally pressure loaded doctor blade was used in conjunction with the standard practice of utilizing means for reciprocating the blade longitudinally of the roll. It developed in the course of experimental use that over a relatively short period, fibers began to build up on the leading edge of the doctor blade until enough fiber had accumulated to force the blade so far away from the roll as to lose its doctoring effect. It therefore became clear that a new doctoring technique was needed.

SUMMARY OF THE INVENTION

In accordance with the invention, it was discovered that these problems could be successfully solved by employing a doctor blade of substantially heavier proportions than blades of the conventional type, and by supporting this blade with its working edge in close but spaced relation with the roll surface, e.g. with the space between the blade edge and the roll being in the range of 0.010 to 0.100 inch. As is explained in detail below in connection with the illustrated preferred embodiment of the invention, this novel non-contacting doctor arrangement will effect substantially complete removal of the thickened pulp from the bare surface of the roll, and if any pulp should move past it and remain on the roll, will promptly be remixed with partially dewatered pulp in such manner that it will be removed from the roll on its next movement past the doctor blade.

As noted above, the pulp stock with which this type of apparatus is commonly used can be expected to contain fairly large size contaminant materials, of which paperclips and staples offer the most difficulty because of their tendency to catch on the working edge of a doctor blade which is not in contact with the associated roll. In the practice of the invention, this difficulty is overcome by providing the non-contacting doctor blade with sufficient rigidity, and also by periodically moving the working edge of the blade with respect to the roll surface, and especially by temporary movement of the blade edge further away from the roll surface. It has been found in test operation that combination of this movement of the doctor blade in conjunction with the movement of the thickened pulp therepast will effectively dislodge any paperclip type of contaminant material from the blade, and such contaminants are readily removed during subsequent screening operations.

Other advantages of the invention will be apparent from or pointed out in the course of the Description of the Preferred Embodiment of the Invention which follows.

DESCRIPTION OF THE PREFERRED EMBODIMENT

Figure 1:
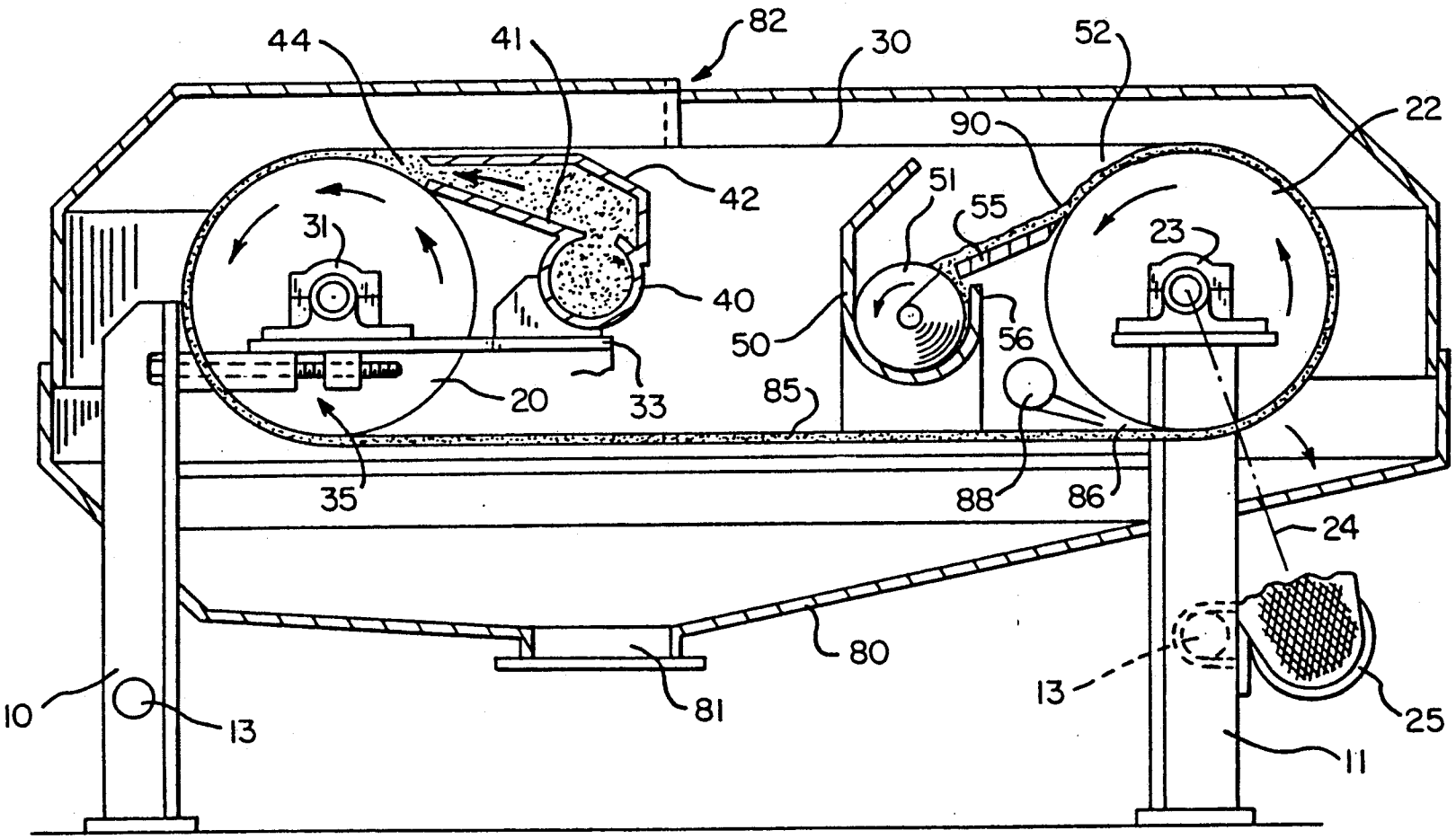
FIG. 1 is a somewhat diagrammatic side view, partly in section, of thickening apparatus with which the present invention is used.

FIG. 1 illustrates the principal structure of the thickening apparatus described and claimed in U.S. Pat. No. 4,722,793. It includes a relatively simple frame comprising two columns 10 and 11 on each side connected by side beams 11 and suitable cross braces 13. The two large rolls 20 and 22 which are the major operating elements of this apparatus are mounted adjacent opposite ends of the frame, the roll 22 being shown as mounted by pillow block bearings 23 on the tops of columns 10 and 11. This roll 22 is a driven roll, through the belt drive indicated generally at 24 by a motor 25 mounted on the cross brace 13 between the columns 10 and 11. The rolls 20 and 22 should have liquid-impervious outer surfaces, but preferably the surface of roll 20 should be grooved, as described in the above patent.

An endless loop of woven foraminous "wire" belt 30 is trained around the rolls 20 and 22 and defines therewith a space in which the other operating parts of the apparatus are located. Preferably the wire 30 will consist of any plastic material currently used for paper machine wires, e.g. polyester. Roll 20 has an adjustable mounting on the frame which includes means for tensioning the wire, each of the journals of the roll 20 being mounted by a pillow block 31 on a base 33 which is in turn mounted for sliding movement on the side beam 12. Means such as a pair of jack screws 35 connected between bases 33 and the adjacent columns 10 cause and control this movement to effect corresponding control of the tension in wire 30.

A headbox 40 is mounted on the same base members 33 as the roll 20 so that it maintains a fixed spacing with respect to roll 20. This headbox is shown as of any open type including lower and upper walls 41 and 42 which extend upwardly to define a spout through which stock is discharged into the wedge zone 44 defined by the upper run of wire 30 approaching roll 20 and the surface of the roll itself. The stock to be thickened is fed to the headbox by any convenient feed line (not shown) from the usual stock supply pump (not shown).

At the other end of the space defined by the upper and lower runs of the wire 30 and the rolls 20 and 22 is a trough 50 having a screw conveyor 51 mounted in the bottom thereof for receiving thickened pulp from the surface of roll 22 in the wedge zone 52 defined by the roll surface and the upper run of wire 30 leaving this roll. A doctor blade 55 bridges the space between the bare surface of roll 22 and the upstream wall 56 of trough 50 to transfer the thickened pulp from the surface of roll 22 to trough 50, and the screw 51 forces the accumulated pulp to a chute (not shown) at the back of the machine which leads to the next station in the system.

Figure 4:
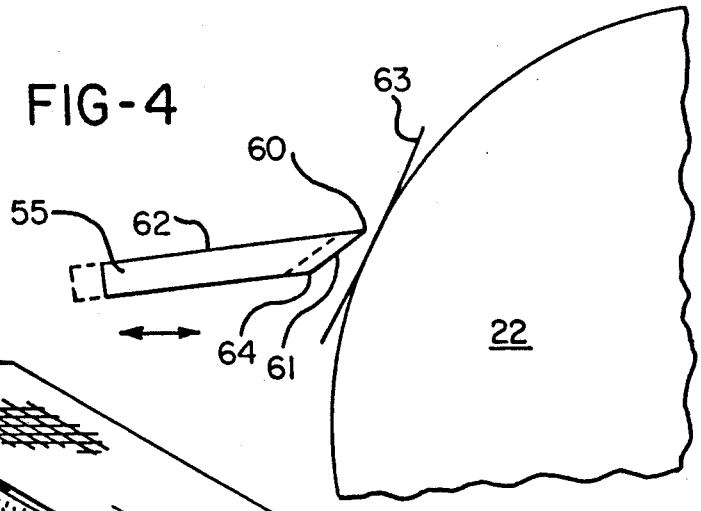
FIG. 4 is an enlarged fragmentary view illustrating a modified mounting for the doctor blade shown in FIGS. 1–3.
Figure 2:
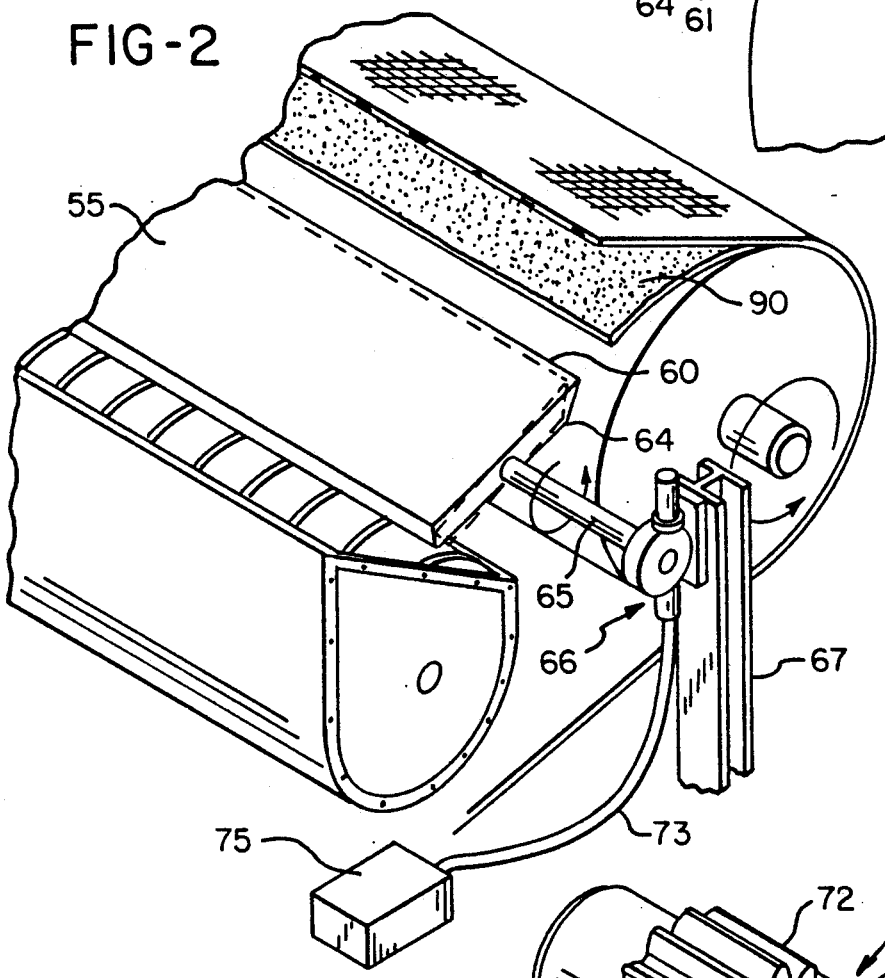
FIG. 2 is a somewhat diagrammatic isometric view illustrating the structural arrangement of the doctor blade shown in FIG. 1.
Figure 3:
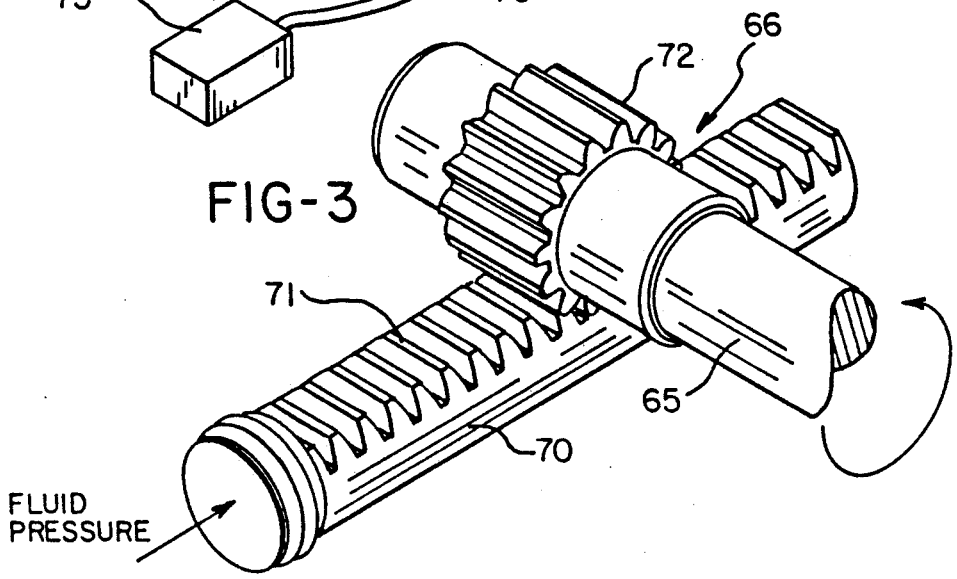
FIG. 3 is a fragmentary isometric view further illustrating the operation of the doctor blade shown in FIGS. 1–2.

Details of the structure and mode of operation of the doctor blade 55 are illustrated in FIGS. 2–4. The blade 55 is shown as a rigid board or plate like member which is as long as the roll 22 and of sufficient width to extend from the bare surface of roll 22 into overhanging relation with the top of trough wall 56. The thickness of doctor blade 55 depends upon its constituent material and should be sufficient to maintain the blade rigid; for example, a thickness of the order of ¾ inch has been found satisfactory with a blade 55 fabricated of Formica material and approximately 5 inches in width.

A steel blade 55 could be of comparable rigidity with a lesser thickness, e.g. ½ inch and a relatively thin and flexible blade could be used if it is mounted on a rigid support or otherwise reinforced. With the doctor blade 55 of the illustrated thickness, it is provided with a relatively wide angled working edge 60 formed by grinding a beveled surface 61 along its upstream side, and an angle in the range of 30°–60° between this surface 61 and the upper surface 62 of the blade may be used.

A blade in the sharper portion of this range has a wider range of adjustment with respect to the angle defined by its upper surface 62 and a tangent 63 to the closest portion of the roll surface. It also facilitates maintaining the desirable greater clearance between tangent 63 and the trailing edge 64 of beveled surface 61 than the minimum clearance between the leading edge 60 and the roll face at tangent 63.

The blade 55 can be mounted in a variety of ways, but preferred results have been obtained in test operation with a mounting which provides for rocking movement between an operating position shown in full lines in FIG. 2 and a raised position shown in broken lines in FIG. 2, as further explained below. For example, as illustrated in FIG. 3, the doctor blade 55 may be provided at each end with a shaft 65 having its outer end supported for rocking movement in an assembly 66 which is in turn mounted in any suitable way on a portion 67 of the main frame 10.

The purpose and function of the assembly 66 is to rock the doctor blade 55 between its two positions illustrated in FIG. 2. Satisfactory results have been obtained utilizing as the assembly 66 a commercial product marketed as "Parker HydroPower Rack & Pinion Rotary Actuator" by Parker Hanifin Corp., Rotary Actuator Division. As illustrated in FIG. 3, this assembly 66 includes a rack 70 which acts as the reciprocating piston of a double acting fluid pressure cylinder and has its teeth 71 meshing with a pinion 72 secured to the adjacent shaft 65.

A line 73 supplies operating fluid to the assembly 66 by way of a timer-controlled valve 75 which can be set to operate the assembly 66 at desired periodic intervals. Thus for each double stroke of the piston 70, the doctor blade 55 will rotate out of and back to its operating full line position as shown in FIG. 2, and it has been found advantageous to cause this action at intervals of the order of 10 minutes for a period of a few seconds, e.g. five or less during which any material which may have "stapled" over the blade edge will be carried away. Alternatively, the mountings for shafts 65 could be changed so that the blade 55 reciprocates lengthwise of roll 22 or moves back and forth linearly with respect to roll 22, as illustrated in FIG. 4. A combination of mountings can also be used to cause the blade to reciprocate lengthwise of roll 22 as well as back and forth with respect thereto.

In the operation of this apparatus, the pulp suspension to be thickened is initially supplied to the space between the wire 30 and roll 20 from the headbox 40, and it is desired that the wire tension be sufficiently low as to encourage the entry of a substantial volume of pulp suspension to enter the space between the wire and the surface of roll 20. This result is aided if the surface of the roll 20 is grooved, as explained in the above-noted U.S. Pat. No. 4,722,793, but preferred results are obtained if the roll 22 has a smoothly imperforate surface.

As is described in U.S. Pat. No. 4,722,793, the primary action of the wire is to serve as a filter medium that holds the fiber on its inner surface against the action of centrifugal force, which is the major factor causing dewatering of the retained pulp at the contemplated wire speeds in the range of 3,000 or more feet per minute. The white water expressed in this manner through the wire is initially received in a trough 80 which extends under both of rolls 20 and 22 and is provided with a drain outlet 81. A hood 82 is mounted above the apparatus as a whole, and it fits into the top of the trough 80 so that any water hitting the inner surface of this hood will drip therefrom into the trough 80.

With the roll 20 having a grooved or otherwise indented surface, the pulp which is thickened as it travels around this roll with the wire will remain as a relatively smooth layer 85 on the wire and travel thereon to the roll 22. Additional stock to be thickened may be applied thereon at the wedge zone 86 defined by the lower run of the wire and the roll 22, as indicated by the secondary headbox 88 and as described in U.S. Pat. No. 4,722,793.

The function of the doctor blade 55 is to remove from the surface of roll 22 the layer 90 of pulp which has been thickened during its travel around this roll, and to transfer that pulp to the trough 50. It has been found that this removal and transfer is effected smoothly, and while avoiding the possibility of abrasion damage to the roll surface, by having the working edge of the doctor blade 55 spaced out of contact with the roll surface rather than pressure loaded against this surface as in the conventional practice, and by oscillating the blade 55 as described.

More specifically, the first layer of pulp on the bare surface of roll 22 will be of a thickness in the range of 0.009 to 0.062 inch, and although the blade edge 60 is spaced out of contact with the roll surface, if it intercepts any of the thickness of this pulp layer, the remainder of the layer will tend to lift off the roll surface with the intercepted portion of the layer. In other words, the blade edge 60 does not tend to cleave the layer of pulp on the roll, and whatever pulp lies between edge 60 and the roll surface will tend to cling to and be lifted off with the portion of the layer which is intercepted by blade edge 60.

If, however, any pulp remains on the roll surface, or if the initial layer is thinner than the space between the bare surface of the roll 22 and the blade edge 60, this has no material effect, because the pulp layer will be carried back into the wedge zone 85 where additional pulp entering that wedge zone on the surface of the wire will be laid on top of the layer already on the roll. Thus it will travel around on the roll a second time, or even multiple times, but will ultimately be removed down to the bare roll surface when it accumulates to a sufficient thickness to catch on the blade edge 60.

The operating position of doctor blade 55 shown in full lines in FIG. 2 can be established by initial adjustment of the assembly 66, or by mechanical stops. However this is done, the operating position of the doctor blade 55 should locate its edge 60 in close but spaced relation with the bare surface of roll 22. Test operations have indicated that optimum results are obtained with this position locating the blade edge 60 at a space of 0.010 inch from the bare surface of roll 22, although satisfactory results may be obtained at greater spacings, up to as much as 0.100 inch, as may be determined by the operator in accordance with the type of stock being thickened. The dotted line position of blade 55 in FIG. 2 preferably provides a space of the order of 3/16 inch between edge 60 and the bare surface of roll.

As noted above, it is anticipated that thickeners of the illustrated type will often be used for thickening waste paper stock which has not been sufficiently screened to remove metallic contaminants such as paperclips and staples. If the apparatus is operated with the doctor blade 55 held in fixed position, items of this type will tend to catch on the edge of a doctor blade of conventional relatively small thickness. According to the invention, however, not only is this action inhibited by the relatively wide-angled doctor blade, but if any such objects should catch thereon, they will be dislodged by the periodic movement of the blade so that they are then carried on into the trough 50 by the continuing stream of thickened pulp for removal by subsequent cleaning and/or screening.

While the forms of apparatus herein described constitutes preferred embodiments of the invention, it is to be understood that the invention is not limited to these precise forms of apparatus and that changes may be made therein without departing from the scope of the invention which is defined in the appended claims.

What is claimed is:

1. In apparatus for thickening a suspension of pulp material in water, comprising means defining a frame, first and second liquid-impervious rolls rotatably mounted on substantially parallel axes in spaced relation in said frame, an endless foraminous wire trained around said rolls in wrapping relation with a substantial portion of the surfaces thereof headbox means including an outlet for the pulp suspension to be thickened so positioned that said outlet causes the pulp suspension to be delivered into and to be trapped in the space between said first roll and the portion of said wire wrapping said roll, means for driving one of said rolls to cause said wire to travel around said rolls at a speed effecting the development of centrifugal force causing liquid to be expressed through the portion of said wire wrapping each of said rolls and thereby to thicken the pulp carried on the inner surface of said wire, and means for collecting the resulting thickened pulp from the surface of said second roll, characterized in that said last named means comprises:

(a) trough means supported in said frame adjacent but spaced from the portion of said second roll not wrapped by said wire, (b) a doctor blade having a working edge of the same effective length as said second roll for effecting transfer of said thickened pulp from the surface of said second roll to said trough means, (c) means supporting said doctor blade with said working edge thereof in close but spaced relation with said roll surface to effect removal of said thickened pulp from said surface without direct contact with said surface, (d) means including said doctor blade of sufficient width to extend from said roll surface to said trough to deliver said removed pulp to said trough, and (e) means for periodically moving said working edge of said doctor blade away from and back to said close but spaced relation with said roll surface.

2. Apparatus as defined in claim 1 further characterized in that said doctor blade is a plate-like member of substantial thickness and rigidity, and the edge thereof adjacent said roll is beveled to define an acute angle with the upper surface of said blade and thereby to provide a relatively sharp knife edge on said blade which is substantially closer to said roll surface than the lower edge of said beveled edge.

3. In apparatus for thickening a suspension of pulp material in water, comprising means defining a frame, a roll rotatably mounted in said frame, and an endless foraminous wire trained around said roll in wrapping relation with a substantial portion of the surface thereof, headbox means including an outlet for the pulp suspension to be thickened so positioned that said outlet causes the pulp suspension to be delivered into and to be trapped in space between said roll and the portion of said wire wrapping said roll, means for driving said roll and wire to cause said trapped suspension to travel therewith around the rotational axis of said roll while liquid trapped with said suspension is extruded through said wire, and means for removing the resulting thickened pulp from the surface of the roll, characterized in that said last named means comprises:

(a) a doctor blade having a working edge of the same effective length as said roll for effecting transfer of said thickened pulp from the surface of said roll, (b) means supporting said doctor blade with said working edge thereof in close but spaced relation with said roll surface to effect removal of said thickened pulp from said surface without direct contact with said surface, and (c) means for periodically moving said working edge of said doctor blade away from and back to said close but spaced relation with said roll surface.

* * * * *